US008559859B2

(12) United States Patent
Hainley et al.

(10) Patent No.: US 8,559,859 B2
(45) Date of Patent: Oct. 15, 2013

(54) MULTI-CHAMBERED AIR KNIFE FOR IMAGE FORMING SYSTEM

(75) Inventors: Rebecca Mary Hainley, Portland, OR (US); Brendan H. Williamson, Rochester, NY (US); Erwin Ruiz, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 138 days.

(21) Appl. No.: 13/272,911

(22) Filed: Oct. 13, 2011

(65) Prior Publication Data

US 2013/0094885 A1 Apr. 18, 2013

(51) Int. Cl.

| | |
|---|---|
| ***G03G 15/00*** | (2006.01) |
| ***G03G 15/20*** | (2006.01) |
| ***G03G 21/00*** | (2006.01) |

(52) U.S. Cl.
USPC ..... 399/323; 271/309; 271/900; 399/398

(58) Field of Classification Search
USPC ..... 399/323, 398; 271/900, 307, 309
See application file for complete search history.

(56) References Cited

U.S. PATENT DOCUMENTS

| | | | | |
|---|---|---|---|---|
| 2005/0156377 | A1* | 7/2005 | Jacobs | 271/309 |
| 2009/0279928 | A1* | 11/2009 | Ishikawa | 399/323 |
| 2011/0091249 | A1* | 4/2011 | Murakami et al. | 399/323 |
| 2011/0097121 | A1* | 4/2011 | Yamamoto et al. | 399/323 |

* cited by examiner

*Primary Examiner* — Sophia S Chen
(74) *Attorney, Agent, or Firm* — Ronald E. Prass, Jr.; Prass LLP

(57) ABSTRACT

An air knife for separating media from a roll in an image forming system includes a body; a first air plenum; a first plenum passage fluidly connected to the first air plenum; a first exit passage fluidly connected to the first plenum passage; a first air exit fluidly connecting the first exit passage to an outside of the body such that the first air plenum is fluidly connected to the outside of the body through the first air exit; a second air plenum separated from the first air plenum such that fluid in the second air plenum is separated from fluid in the first air plenum; a second plenum passage fluidly connected to the second air plenum; a second exit passage fluidly connected to the second plenum passage; and a second air exit fluidly connecting the second exit passage to an outside of the body.

20 Claims, 3 Drawing Sheets

MULTI-CHAMBERED AIR KNIFE FOR IMAGE FORMING SYSTEM

BACKGROUND

The present disclosure relates generally to separating media from a roll in image forming devices. More particularly, the present disclosure describes an apparatus and system useful for separating media from a roll using an air knife.

Some fusing technologies use an air knife to strip media from the fusing surface when the media does not have the beam strength to overcome the adhesive forces between the toner and the fusing surface. The air knife operates by blowing air through jets placed in the cross process direction. The continuous blowing of air onto the fuser roll or belt introduces many local cold spots where the jets align with the fuser, which in turn can result in low gloss streaks on the fused image. One solution to the streaks caused by the air knife is to turn the air knife off. However, this solution is less than ideal because, among other things, it reduces the types of media that can be used, particularly as the belt ages.

SUMMARY

The present disclosure reduces the cooling effect of the air knife by reducing the exposure of the jetted air onto the fusing surface. This reduction is achieved by an air knife with multiple separate chambers in the air knife plenum, with each chamber controlling a portion of the jets. In embodiments, the airflow alternates between the chambers, which (1) allows more time between air knife cycles to allow for temperature recovery of the fusing surface, and (2) creates a more uniform temperature profile across the fusing surface. The reduction of the temperature variation across the fusing surface can reduce or eliminate the presence of low gloss air knife streaks.

An air knife is provided for separating media from a roll in an image forming system. The air knife includes a main body; a first air plenum inside the main body; a first plenum passage fluidly connected to the first air plenum; a first exit passage fluidly connected to the first plenum passage; a first air exit fluidly connecting the first exit passage to an outside of the main body such that the first air plenum is fluidly connected to the outside of the main body through the first air exit; a second air plenum inside the main body and separated from the first air plenum such that fluid in the second air plenum is separated from fluid in the first air plenum; a second plenum passage fluidly connected to the second air plenum; a second exit passage fluidly connected to the second plenum passage; and a second air exit fluidly connecting the second exit passage to an outside of the main body such that the second air plenum is fluidly connected to the outside of the main body through the second air exit.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the present embodiments and further features and advantages thereof may be acquired by referring to the following description taken in conjunction with the accompanying drawings, wherein.

DETAILED DESCRIPTION

Figure 1:
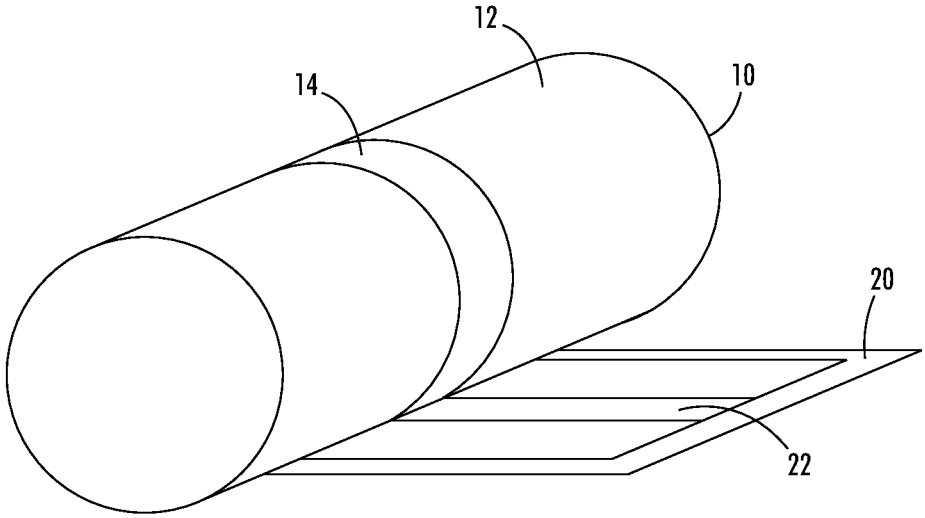
FIG. 1 is an exemplary schematic diagram of an image forming system showing localized cooling.

Illustrative embodiments are described in detail below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure.

The disclosed embodiments may include an air knife for separating media from a roll in an image forming system. The air knife includes a main body; a first air plenum inside the main body; a first plenum passage fluidly connected to the first air plenum; a first exit passage fluidly connected to the first plenum passage; a first air exit fluidly connecting the first exit passage to an outside of the main body such that the first air plenum is fluidly connected to the outside of the main body through the first air exit; a second air plenum inside the main body and separated from the first air plenum such that fluid in the second air plenum is separated from fluid in the first air plenum; a second plenum passage fluidly connected to the second air plenum; a second exit passage fluidly connected to the second plenum passage; and a second air exit fluidly connecting the second exit passage to an outside of the main body such that the second air plenum is fluidly connected to the outside of the main body through the second air exit.

The disclosed embodiments may include a media separation system for separating media from a roll in an image forming system. The media separation system includes an air source; a valve that directs air from the air source into a first outlet and a second outlet, the valve being selectable such that the air can be directed into only one of the first and second outlets at a time; a first supply line fluidly connected to the first outlet; a second supply line fluidly connected to the second outlet; and an air knife having a main body; a first air plenum inside the main body, the first air plenum being fluidly connected to the first supply line; a first plenum passage fluidly connected to the first air plenum; a first exit passage fluidly connected to the first plenum passage; a first air exit fluidly connecting the first exit passage to an outside of the main body such that the first air plenum is fluidly connected to the outside of the main body through the first air exit; a second air plenum inside the main body, the second air plenum being fluidly connected to the second supply line and separated from the first air plenum such that fluid in the second air plenum is separated from fluid in the first air plenum; a second plenum passage fluidly connected to the second air plenum; a second exit passage fluidly connected to the second plenum passage; and a second air exit fluidly connecting the second exit passage to an outside of the main body such that the second air plenum is fluidly connected to the outside of the main body through the second air exit The disclosed embodiments may include an image forming system for forming an image on media. The image forming system includes a housing; a fuser surface located in the housing; a pressure surface located in the housing; a media path between the fuser surface and the pressure surface; a media separation system for separating the media from the fuser surface, the media separation system having an air source; a valve that directs air from the air source into a first outlet and a second outlet, the valve being selectable such that the air can be directed into only one of the first and second outlets at a time; a first supply line fluidly connected to the first outlet; a second supply line fluidly connected to the second outlet; and an air knife having a main body; a first air plenum inside the main body, the first air plenum being fluidly connected to the first supply line; a first plenum passage fluidly connected to the first air plenum; a first exit passage fluidly connected to the first plenum passage; a first air exit fluidly connecting the first exit passage to an outside of the main body such that the first air plenum is fluidly connected to the outside of the main body through the first air exit; a second air plenum inside the main body, the second air plenum being fluidly connected to the second supply line and separated from the first air plenum such that fluid in the second air plenum is separated from fluid in the first air plenum; a second plenum passage fluidly connected to the second air plenum; a second exit passage fluidly connected to the second plenum passage; and a second air exit fluidly connecting the second exit passage to an outside of the main body such that the second air plenum is fluidly connected to the outside of the main body through the second air exit. The first and second air exits direct the air toward an area in which the media contacts the fuser surface in order to separate the media from the fuser surface.

In a fusing subsystem, an air knife can be used to assist the stripping of the printed media off of the fusing surface. The air knife can be a triangular shaped air plenum with jets directing high pressure air towards the location where the media releases from the fusing surface. An unintended consequence of the air blowing on the fusing surface can be the localized cooling of the fusing surface. The rotation of the fusing surface distributes the cooling circumferentially, but the stagnant position of the jet can result in large temperature differences along the axial direction of the fusing surface. Localized cooling of the fusing surface can result in a gloss differential on the fused media, referred to as air knife gloss streaks. The higher the temperature difference between the normal temperature of the fuser surface and the cooled area in line with the air jets, the worse the air knife gloss streaks will be. FIG. 1 shows an example of a piece of media 20 being stripped from a fuser roll 10. A normal temperature zone 12 exists on the fusing surface of the fuser roll 10 except in a cool zone 14 that results from an air jet that is stagnant in its position. An air knife gloss streak is represented in FIG. 1 by area 22.

The current disclosure uses multiple air plenums (or multiple chambers in one air plenum) within the air knife to cycle the location of air jetting. By cycling on and off the air jets, the fusing surface in line with any one particular air jet will experience less cooling. Less cooling will reduce the temperature differential between the axial location on the fusing surface in line with the air jets and in between the air jets. One embodiment of this disclosure is an air knife with two plenums, as shown in FIGS. 2-5. However, other embodiments can have three or more plenums, each fluidly connected to its own set of air jets.

In a two-plenum air knife having twice as many jets as a single plenum air knife, by alternating the plenum source for the jets along the air knife, the same number of jets as the single plenum air knife would be acting on the system at any time. An example of an algorithm for the stripping cycle alternates the high/low cycling between the two air plenums, with one plenum having no pressure while the other plenum is acting on the system. More than two plenums can also be used and would further reduce the cooling effect of an individual jet since it would allow a longer "off" cycle.

Figure 2:
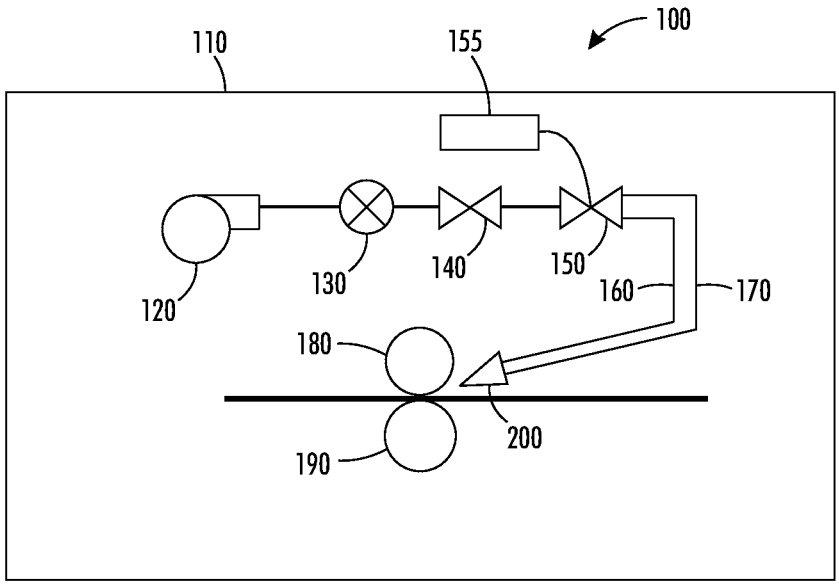
FIG. 2 is an exemplary schematic diagram of an image forming system in accordance with embodiments of the disclosure.

FIG. 2 shows an example of an image forming system 100 in accordance with embodiments of the disclosure. This example includes a housing 110 that houses an air knife 200 and various support elements. A compressor 120 provides air to a regulator 130 that regulates the pressure seen by an enable valve 140 that can either allow the air to flow downstream or cut off the supply of air completely. If enable valve 140 is open, the air flows downstream to a valve 150 (in this example, a solenoid valve) which can be controlled by a controller 155. Valve 150 has a plurality of positions including one for each of a plurality of plenums in air knife 200. In the example shown, valve 150 has a first position in which all of the air flows through valve 150 into supply line 160 that leads to a first plenum 300 of air knife 200. Valve 150 also has a second position in which all of the air flows through valve 150 into supply line 170 that leads to a second plenum 400 of air knife 200.

FIG. 2 shows a first roll 180 and a second roll 190 between which a piece of media (not shown) travels. In this example, first roll 180 is a fuser roll and second roll 190 is a pressure roll. However, it is noted that the rolls can be rolls other than those specified in this example, and the rolls can instead be belts or other surfaces. Air knife 200 is pointed toward the location where the piece of media is to be stripped from fuser roll 180. Air from the compressor, after following the path described above, is ejected from the air knife and separates the piece of media from fuser roll 180.

Figure 3:
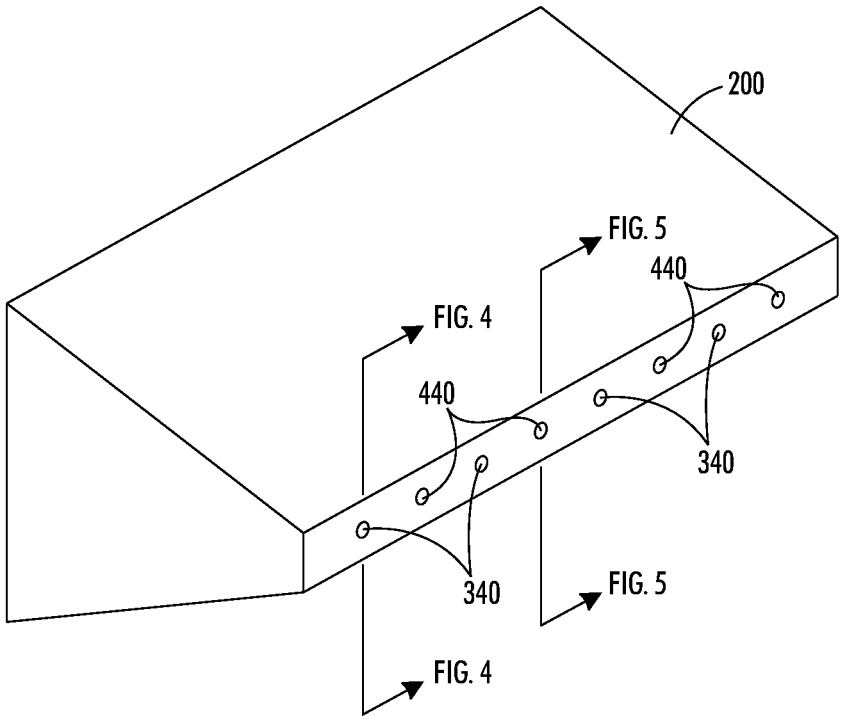
FIG. 3 is a perspective view of an air knife in accordance with embodiments of the disclosure.
Figure 4:
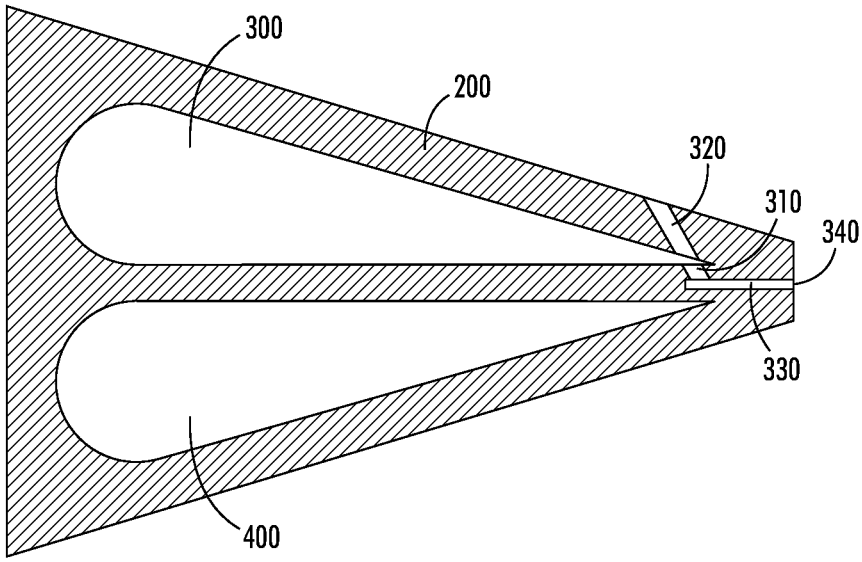
FIG. 4 is a sections view along section line FIG. 4-FIG. 4 in FIG. 3.
Figure 5:
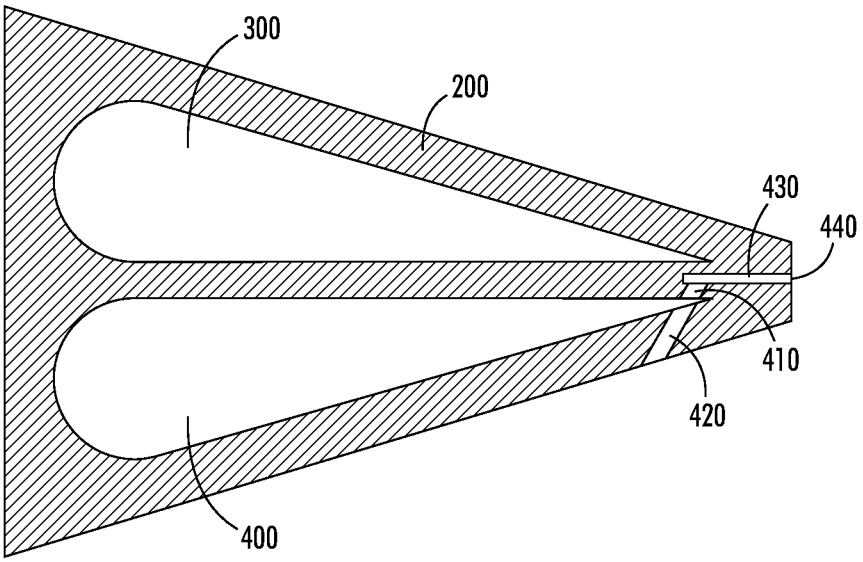
FIG. 5 is a sections view along section line FIG. 5-FIG. 5 in FIG. 3.

FIGS. 3-5 show air knife 200 in more detail. As shown in FIG. 3, air knife 200 is, in this example, roughly triangular in cross section with a plurality of holes or air exits 340, 440 in one end. FIG. 4 shows a cross section of air knife 200 taken along section line IV-IV in FIG. 3 through one of the air exits 340. FIG. 5 shows a cross section of air knife 200 taken along section line V-V in FIG. 3 through one of the air exits 440.

In this example, air knife 200 has a first plenum 300 and a second plenum 400 that are fluidly isolated from each other. Other examples can have three or more plenums. As explained above, supply line 160 provides air from valve 150 to first plenum 300 and supply line 170 provides air from valve 150 to second plenum 400.

FIG. 4 shows first plenum 300 fluidly connected to air exit 340 by way of a first plenum passage 310 and a first exit passage 330. A manufacturing bore 320 is shown that is created when first plenum passage 310 is formed by boring a hole through the body of air knife 200. Manufacturing bore 320 is filled during manufacturing to seal off first plenum 300. The cross section of air knife 200 is similar to FIG. 4 at each air exit 340. This example includes four air exits 340, but other examples have more or fewer air exits fluidly connected to first plenum 300.

FIG. 5 shows second plenum 400 fluidly connected to air exit 440 by way of a second plenum passage 410 and a second exit passage 430. A manufacturing bore 420 is shown that is created when second plenum passage 410 is formed by boring a hole through the body of air knife 200. Manufacturing bore 420 is filled during manufacturing to seal off second plenum 400. The cross section of air knife 200 is similar to FIG. 5 at each air exit 440. This example includes four air exits 440, but other examples have more or fewer air exits fluidly connected to second plenum 400.

By alternating air flow between first plenum 300 and second plenum 400, air is alternately jetted from air exits 340 and 440, respectively, to separate the piece of media from fuser roll 180. In this example, when air is exiting air exits 340, no air is exiting air exits 440. And when air is exiting air exits 440, no air is exiting air exits 340. Valve 150 may also have a third (closed) position in which no air is passed to either air supply line. In the closed position no air is jetted out of the air exits. The closed position can be used, among other times, between sheets of media and/or after proper separation of a particular sheet of media is achieved.

By cycling on and off air exits 340, the fuser surface in line with air exits 340 will experience less cooling. Less cooling will reduce the temperature differential between the axial location on the fuser surface in line with air exits 340 and the locations between air exits 340. The same is true for air exits 440. This alternating air flow provides sufficient force to strip the media from the fusing surface while at the same time evens out the cooling of the fusing surface.

While this example uses two plenums, two air supply lines and a valve that has two different open positions, it is noted that three or more plenums can be used. In the case of three plenums, three air supply lines would be provided and a valve having three different open positions would be used. As in the example in the figures, each plenum would have its own set of air exits fluidly connected to it.

While the example shown in the figures has four air exits fluidly connected to each plenum, more or fewer air exits can be provided for each plenum. Also, the pattern and orientation of air exits 340 and 440 are exemplary only and do not preclude other patterns and/or orientations.

As used herein, the term "image forming system" encompasses any apparatus that performs a print outputting function for any purpose. Such apparatuses can include, e.g., a digital copier, bookmaking machine, multifunction machine, and the like. The image forming system can use various types of solid and liquid marking materials, including toner and inks (e.g., liquid inks, gel inks, heat-curable inks and radiation-curable inks), and the like. The image forming systems can use various thermal, pressure and other conditions to treat the marking materials and form images on media.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. An air knife for separating media from a roll in an image forming system, the air knife comprising:

a main body;

a first air plenum inside the main body;

a first plenum passage fluidly connected to the first air plenum;

a first exit passage fluidly connected to the first plenum passage;

a first air exit fluidly connecting the first exit passage to an outside of the main body such that the first air plenum is fluidly connected to the outside of the main body through the first air exit;

a second air plenum inside the main body and separated from the first air plenum such that fluid in the second air plenum is separated from fluid in the first air plenum;

a second plenum passage fluidly connected to the second air plenum;

a second exit passage fluidly connected to the second plenum passage; and a second air exit fluidly connecting the second exit passage to an outside of the main body such that the second air plenum is fluidly connected to the outside of the main body through the second air exit.

2. The air knife of claim 1, further comprising a plurality of first plenum passages fluidly connected to the first air plenum;

a separate first exit passage fluidly connected to each of the first plenum passages; and a separate first air exit fluidly connecting each of the first exit passages to the outside of the main body such that the first air plenum is fluidly connected to the outside of the main body through each of the first air exits.

3. The air knife of claim 2, further comprising a plurality of second plenum passages fluidly connected to the second air plenum;

a separate second exit passage fluidly connected to each of the second plenum passages; and a separate second air exit fluidly connecting each of the second exit passages to the outside of the main body such that the second air plenum is fluidly connected to the outside of the main body through each of the second air exits.

4. The air knife of claim 3, wherein the first and second air exits are arranged on a face of the main body such that one of the first air exits is positioned between two of the second air exits.

5. The air knife of claim 4, wherein the first and second air exits are arranged on the face of the main body such that one of the second air exits is positioned between two of the first air exits.

6. The air knife of claim 5, wherein the first and second air exits are arranged along a straight line on the face of the main body such that the first and second air exits alternate along the line.

7. A media separation system for separating media from a roll in an image forming system, the media separation system comprising:

an air source;

a valve that directs air from the air source into a first outlet and a second outlet, the valve being selectable such that the air can be directed into only one of the first and second outlets at a time;

a first supply line fluidly connected to the first outlet;

a second supply line fluidly connected to the second outlet; and an air knife having a main body;

a first air plenum inside the main body, the first air plenum being fluidly connected to the first supply line;

a first plenum passage fluidly connected to the first air plenum;

a first exit passage fluidly connected to the first plenum passage;

a first air exit fluidly connecting the first exit passage to an outside of the main body such that the first air plenum is fluidly connected to the outside of the main body through the first air exit; a second air plenum inside the main body, the second air plenum being fluidly connected to the second supply line and separated from the first air plenum such that fluid in the second air plenum is separated from fluid in the first air plenum;

a second plenum passage fluidly connected to the second air plenum;

a second exit passage fluidly connected to the second plenum passage; and a second air exit fluidly connecting the second exit passage to an outside of the main body such that the second air plenum is fluidly connected to the outside of the main body through the second air exit.

8. The media separation system of claim 7, further comprising a controller that controls the valve such that the air is supplied to the first supply line and the second supply line in an alternating manner.

9. The media separation system of claim 7, further comprising a plurality of first plenum passages fluidly connected to the first air plenum;

a separate first exit passage fluidly connected to each of the first plenum passages; and a separate first air exit fluidly connecting each of the first exit passages to the outside of the main body such that the first air plenum is fluidly connected to the outside of the main body through each of the first air exits.

10. The media separation system of claim 9, further comprising a plurality of second plenum passages fluidly connected to the second air plenum;

a separate second exit passage fluidly connected to each of the second plenum passages; and a separate second air exit fluidly connecting each of the second exit passages to the outside of the main body such that the second air plenum is fluidly connected to the outside of the main body through each of the second air exits.

11. The media separation system of claim 10, wherein the first and second air exits are arranged on a face of the main body such that one of the first air exits is positioned between two of the second air exits.

12. The media separation system of claim 11, wherein the first and second air exits are arranged on the face of the main body such that one of the second air exits is positioned between two of the first air exits.

13. The media separation system of claim 12, wherein the first and second air exits are arranged along a straight line on the face of the main body such that the first and second air exits alternate along the line.

14. An image forming system for forming an image on media, the image forming system comprising:

a housing;

a fuser surface located in the housing;

a pressure surface located in the housing;

a media path between the fuser surface and the pressure surface;

a media separation system for separating the media from the fuser surface, the media separation system having an air source;

a valve that directs air from the air source into a first outlet and a second outlet, the valve being selectable such that the air can be directed into only one of the first and second outlets at a time;

a first supply line fluidly connected to the first outlet;

a second supply line fluidly connected to the second outlet; and an air knife having a main body;

a first air plenum inside the main body, the first air plenum being fluidly connected to the first supply line;

a first plenum passage fluidly connected to the first air plenum;

a first exit passage fluidly connected to the first plenum passage;

a first air exit fluidly connecting the first exit passage to an outside of the main body such that the first air plenum is fluidly connected to the outside of the main body through the first air exit;

a second air plenum inside the main body, the second air plenum being fluidly connected to the second supply line and separated from the first air plenum such that fluid in the second air plenum is separated from fluid in the first air plenum;

a second plenum passage fluidly connected to the second air plenum;

a second exit passage fluidly connected to the second plenum passage; and a second air exit fluidly connecting the second exit passage to an outside of the main body such that the second air plenum is fluidly connected to the outside of the main body through the second air exit, wherein the first and second air exits direct the air toward an area in which the media contacts the fuser surface in order to separate the media from the fuser surface.

15. The image forming system of claim 14, further comprising a controller that controls the valve such that the air is supplied to the first supply line and the second supply line in an alternating manner.

16. The image forming system of claim 15, further comprising a plurality of first plenum passages fluidly connected to the first air plenum;

a separate first exit passage fluidly connected to each of the first plenum passages; and a separate first air exit fluidly connecting each of the first exit passages to the outside of the main body such that the first air plenum is fluidly connected to the outside of the main body through each of the first air exits.

17. The image forming system of claim 16, further comprising a plurality of second plenum passages fluidly connected to the second air plenum;

a separate second exit passage fluidly connected to each of the second plenum passages; and a separate second air exit fluidly connecting each of the second exit passages to the outside of the main body such that the second air plenum is fluidly connected to the outside of the main body through each of the second air exits.

18. The image forming system of claim 17, wherein the first and second air exits are arranged on a face of the main body such that one of the first air exits is positioned between two of the second air exits.

19. The image forming system of claim 18, wherein the first and second air exits are arranged on the face of the main body such that one of the second air exits is positioned between two of the first air exits.

20. The image forming system of claim 19, wherein the first and second air exits are arranged along a straight line on the face of the main body such that the first and second air exits alternate along the line.

* * * * *